US008544224B1

(12) United States Patent
Hafendorfer et al.

(10) Patent No.: US 8,544,224 B1
(45) Date of Patent: Oct. 1, 2013

(54) THERMALLY EFFICIENT FRAMES FOR USE IN CONSTRUCTION OF STRUCTURES USING INSULATED CONCRETE FORMS (ICF) AND METHODS FOR MAKING AND USING SAME

(76) Inventors: Jim Hafendorfer, Louisville, KY (US); Matthew Lyons, Louisville, KY (US); Loren Stout, Louisville, KY (US)

( * ) Notice: Subject to any disclaimer, the term of this patent is extended or adjusted under 35 U.S.C. 154(b) by 183 days.

(21) Appl. No.: 13/052,785

(22) Filed: Mar. 21, 2011

Related U.S. Application Data

(60) Provisional application No. 61/315,554, filed on Mar. 19, 2010.

(51) Int. Cl.

| | |
|---|---|
| ***E06B 1/04*** | (2006.01) |
| ***E06B 1/56*** | (2006.01) |
| ***E04G 11/18*** | (2006.01) |
| ***E04C 2/38*** | (2006.01) |
| ***E04B 2/16*** | (2006.01) |

(52) U.S. Cl.
USPC ..... 52/215; 52/204.54; 52/208; 52/309.12; 52/656.2; 49/504; 49/DIG. 1; 249/39

(58) Field of Classification Search
USPC ..... 52/210, 211, 212, 213, 215, 216, 52/217, 204.1, 204.53, 204.54, 204.56, 208, 52/309.12, 656.2, 656.4, 656.5, 656.9; 49/504, 49/505, DIG. 1; 249/36, 39
See application file for complete search history.

(56) References Cited

U.S. PATENT DOCUMENTS

| | | | | | |
|---|---|---|---|---|---|
| 2,679,796 | A | * | 6/1954 | Froelich et al. | 454/331 |
| 2,787,820 | A | * | 4/1957 | Shields et al. | 249/19 |
| 2,893,235 | A | * | 7/1959 | Goldberg | 52/204.55 |
| 3,001,244 | A | * | 9/1961 | Kronquist | 52/127.2 |
| 3,027,686 | A | * | 4/1962 | Oates | 52/127.2 |
| 3,367,618 | A | * | 2/1968 | Masur | 249/39 |
| 3,769,769 | A | * | 11/1973 | Kohl | 52/212 |
| 3,886,688 | A | * | 6/1975 | Ragland | 49/504 |
| 3,995,843 | A | * | 12/1976 | Kasteler | 269/47 |
| 4,430,831 | A | * | 2/1984 | Kemp | 52/204.53 |
| 4,442,644 | A | | 4/1984 | Jukes | |
| 4,829,727 | A | * | 5/1989 | Kuzara, Jr. | 52/127.2 |
| 4,986,044 | A | * | 1/1991 | Funari | 52/213 |
| 5,319,884 | A | * | 6/1994 | Bergeron | 49/504 |
| 5,369,922 | A | * | 12/1994 | Hansen | 52/204.54 |
| 5,444,947 | A | * | 8/1995 | Miller | 52/100 |
| 5,458,828 | A | * | 10/1995 | Chuang | 264/35 |
| 5,711,120 | A | * | 1/1998 | Karpen | 52/212 |
| 5,746,033 | A | * | 5/1998 | Chuang | 52/213 |
| 5,791,103 | A | * | 8/1998 | Coolman et al. | 52/215 |
| 5,843,323 | A | * | 12/1998 | Ranard | 249/39 |
| 5,843,324 | A | * | 12/1998 | Shirley | 249/39 |
| 5,881,510 | A | * | 3/1999 | Ole | 52/217 |

(Continued)

*Primary Examiner* — Basil Katcheves
*Assistant Examiner* — Rodney Mintz
(74) *Attorney, Agent, or Firm* — Wyatt, Tarrant & Combs, LLP; Matthew A. Williams

(57) ABSTRACT

A thermally efficient frame for use in a wall structure formed using an insulated concrete form comprising an exterior frame assembly having an exterior flange for locating said exterior frame assembly against an exterior portion of the insulated concrete form, an interior frame assembly having an interior flange for locating the interior frame assembly against an interior portion of the insulated concrete form, wherein the exterior frame assembly and the interior frame assembly cooperated to define an opening in said wall structure, and a thermal break thermally separating the exterior frame assembly from the interior frame assembly and methods for using same.

1 Claim, 7 Drawing Sheets

(56) References Cited

U.S. PATENT DOCUMENTS

| | | | | |
|---|---|---|---|---|
| 5,927,043 | A * | 7/1999 | Newkirk | 52/742.14 |
| 5,974,745 | A * | 11/1999 | Barr | 52/212 |
| 5,996,293 | A * | 12/1999 | Anderson et al. | 52/215 |
| 6,070,375 | A | 6/2000 | Anderson et al. | |
| 6,185,884 | B1 * | 2/2001 | Myers et al. | 52/215 |
| 6,305,132 | B1 * | 10/2001 | Smith | 52/204.1 |
| 6,405,506 | B2 | 6/2002 | Ruff | |
| 6,453,620 | B1 * | 9/2002 | Williams et al. | 52/2.15 |
| 6,530,185 | B1 | 3/2003 | Scott et al. | |
| 6,550,194 | B2 * | 4/2003 | Jackson et al. | 52/215 |
| 6,904,727 | B2 * | 6/2005 | Edger | 52/215 |
| 6,945,002 | B2 | 9/2005 | Zambelli et al. | |
| 7,111,433 | B2 | 9/2006 | Kerscher | |
| 7,389,610 | B1 * | 6/2008 | McMakin et al. | 49/254 |
| 7,455,803 | B2 * | 11/2008 | Sanger | 264/334 |
| 7,516,581 | B2 | 4/2009 | Vidal | |
| 7,587,868 | B2 * | 9/2009 | Hughes | 52/215 |
| 7,753,334 | B2 * | 7/2010 | Schreiber | 248/351 |
| 8,069,622 | B2 * | 12/2011 | Mees et al. | 52/213 |
| 8,109,052 | B2 * | 2/2012 | Rosende et al. | 52/204.55 |
| 8,122,653 | B2 * | 2/2012 | Ellebracht et al. | 52/204.1 |
| RE43,251 | E * | 3/2012 | Anderson et al. | 52/204.54 |
| RE43,457 | E * | 6/2012 | Anderson et al. | 52/215 |
| 8,407,953 | B2 * | 4/2013 | Neal | 52/204.54 |
| 8,407,954 | B2 * | 4/2013 | Keith et al. | 52/213 |
| 8,458,969 | B2 * | 6/2013 | Richardson et al. | 52/215 |
| 8,495,843 | B1 * | 7/2013 | Horneland | 52/215 |
| 2001/0034986 | A1 * | 11/2001 | Thomas et al. | 52/211 |
| 2002/0047082 | A1 * | 4/2002 | Jackson et al. | 249/35 |
| 2002/0104952 | A1 * | 8/2002 | Sanger | 249/39 |
| 2003/0005659 | A1 * | 1/2003 | Moore, Jr. | 52/473 |
| 2003/0172601 | A1 * | 9/2003 | Johnson et al. | 52/216 |
| 2004/0177577 | A1 * | 9/2004 | Voegele et al. | 52/306 |
| 2005/0016092 | A1 * | 1/2005 | Whitworth | 52/204.1 |
| 2005/0193653 | A1 | 9/2005 | Cornell | |
| 2006/0005481 | A1 * | 1/2006 | Ouellette | 52/204.1 |
| 2006/0156655 | A1 * | 7/2006 | Rizzotto | 52/215 |
| 2007/0204535 | A1 * | 9/2007 | Hughes | 52/215 |
| 2008/0092472 | A1 | 4/2008 | Doerr et al. | |
| 2008/0120929 | A1 | 5/2008 | Keith et al. | |
| 2008/0196325 | A1 * | 8/2008 | Howorth et al. | 52/127.2 |
| 2008/0271394 | A1 * | 11/2008 | Hand et al. | 52/210 |
| 2009/0013624 | A1 * | 1/2009 | Sibbett | 52/204.62 |
| 2009/0038245 | A1 * | 2/2009 | Temnyenkov | 52/204.599 |
| 2009/0193729 | A1 * | 8/2009 | Kustermann | 52/215 |
| 2009/0205272 | A1 * | 8/2009 | Rosende | 52/215 |
| 2009/0277111 | A1 * | 11/2009 | Albrecht et al. | 52/213 |
| 2010/0043321 | A1 * | 2/2010 | Mees et al. | 52/213 |
| 2010/0251645 | A1 * | 10/2010 | Philippe | 52/215 |
| 2010/0269433 | A1 * | 10/2010 | Westra | 52/215 |
| 2010/0325984 | A1 * | 12/2010 | Richardson et al. | 52/215 |
| 2011/0083382 | A1 * | 4/2011 | Sanders | 52/215 |
| 2011/0154753 | A1 * | 6/2011 | Furgerson et al. | 52/204.1 |
| 2011/0197530 | A1 * | 8/2011 | Bahnmiller | 52/309.4 |
| 2011/0214370 | A1 * | 9/2011 | Stewart | 52/215 |
| 2011/0258944 | A1 * | 10/2011 | Radoane | 52/62 |
| 2012/0137606 | A1 * | 6/2012 | Mees | 52/204.1 |
| 2012/0216478 | A1 * | 8/2012 | Mees | 52/426 |
| 2012/0240494 | A1 * | 9/2012 | Schroeder et al. | 52/210 |
| 2013/0133276 | A1 * | 5/2013 | Furgerson et al. | 52/204.1 |

* cited by examiner

THERMALLY EFFICIENT FRAMES FOR USE IN CONSTRUCTION OF STRUCTURES USING INSULATED CONCRETE FORMS (ICF) AND METHODS FOR MAKING AND USING SAME

CROSS-REFERENCE TO RELATED APPLICATIONS

This application claims the benefit of U.S. Provisional Application No. 61/315,554, filed Mar. 19, 2010, which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

Field of the Invention

The present invention generally relates to thermally efficient window frames for use in construction of structures using insulated concrete forms and methods for making and using same.

SUMMARY OF THE INVENTION

The present invention relates to frames that are used to define openings in walls that are formed using insulated concrete form ("ICF") construction techniques. In this disclosure, the invention is generally described in terms that relate to window openings in such walls, but the invention is equally applicable to door and other necessary openings, such as openings for ventilation, plumbing, and other types of apparatus.

In the illustrated embodiment of the invention that is used to define a window opening, the invention is comprised of a combination of an interior and exterior window frame, support channels, and support panels all made from lengths of steel sheet metal. In the illustrated embodiment, the interior and exterior window frames are rectangular in nature and are comprised of a sill, and a pair of jambs to support a lintel. The exact dimensions of the frame are variable and adapted to provide an opening of the size required by the user, and the shape and number of sides can similarly be varied to suit whatever shape opening is required by the user. The depth, or inside distance between the exterior and interior sill, is dependent on the depth of the ICF. This allows the window frame to fit firmly within the ICF structure before the concrete is poured.

Located between the exterior and interior frame is a thermal break that reduces the heat loss associated with known metal frames used in ICF construction. The use of separate interior and exterior frames also provides the user with the ability to use different materials to fabricate the interior and exterior frames from different materials. For example, the exterior frame can be made of a material, such as stainless steel, that is particularly suited to withstand exterior weather conditions, while the interior frame can be made of a less expensive material that does not need to withstand exterior weather conditions.

The apron or sill contains a set of cutouts so that concrete can be poured through them to ensure the space beneath the opening is completely filled with concrete.

The frame may be supported by support beams on the outside of the fixture. These support beams support the frame against the ICF form as the wall form is constructed and while concrete is being poured into the form and around the fixture. These support beams also serve to anchor the window frame in the structure once the concrete cures and provide additional rigidity to the structure.

Before the frame is installed in the wall form, the interior and exterior portions of the frame are joined together to define a thermal break, or a space for a thermal break, between the interior and exterior frame portions. A removable support structure may also be installed in the opening to provide added support to the frame when the concrete is poured. Once the concrete has cured sufficiently, the support structure is removed.

There may be threaded installation openings to which threaded studs are installed. These openings may be defined in the sill, jambs, or lintel (or header). The threaded studs may serve as connection points for the support panels, as installation points for a variety of manufactured windows, or as anchors to secure the frame within the poured concrete.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
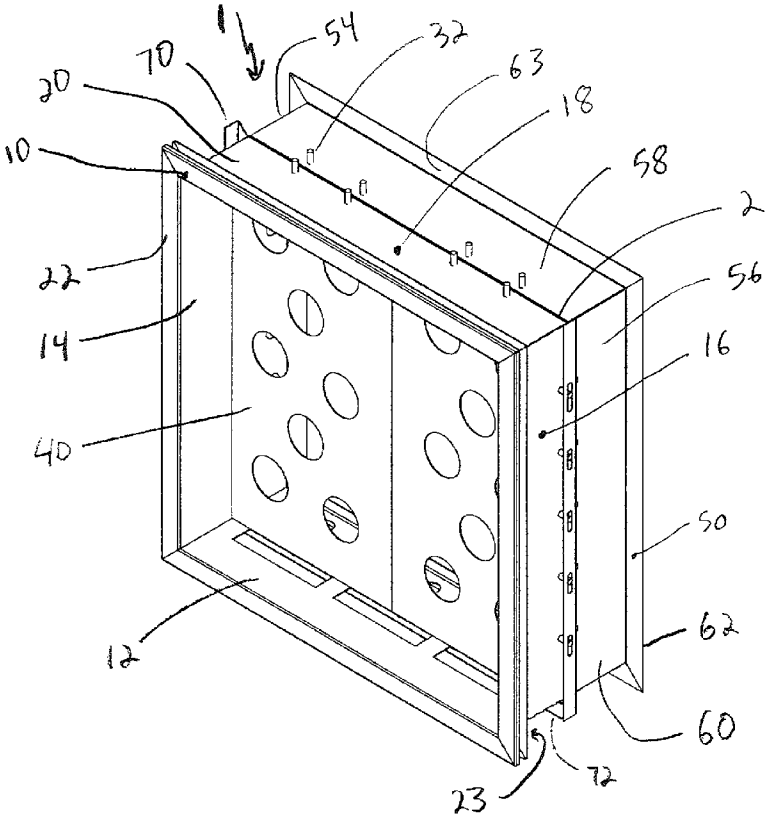
FIG. 1 is a perspective view of an embodiment of the disclosed invention.

FIG. 1 shows an embodiment of the invention. In this embodiment, frame assembly 1 is particularly adapted to define an opening for a rectangular window. Frame assembly 1 comprises exterior frame assembly 10 and interior frame assembly 50. Exterior frame assembly 10 and interior frame assembly 50 are separated by thermal break 2. In one embodiment, thermal break 2 is formed by providing a gap (best seen in Detail of A of FIG. 3) between exterior frame assembly 10 and interior frame assembly 50 that is filled with concrete when the surrounding wall is poured. But any material with sufficient strength to resist the force exerted by the concrete when the concrete is poured into the completed wall form that can be compressed between exterior frame assembly 10 and interior frame assembly 50 while retaining sufficient insulating properties (i.e. a lower capacity to transfer heat than the materials used to form exterior frame assembly 10 and interior frame assembly 50) could be used for thermal break 2.

Exterior frame assembly 10 further comprises exterior sill member 12, exterior left jamb 14, exterior right jamb 16, and exterior header member 18, which are joined together to form exterior frame 20. Exterior flange 22 extends from an exterior perimeter portion of exterior frame 20 in a direction that is outward from the opening defined by exterior frame 20. Exterior flange 22 engages the exterior portion of the ICF to retain the concrete within the insulated form when the concrete is being poured. Exterior flange 22 is also formed to properly mate with the material being used to finish the exterior of the wall being formed. For example, if the wall will be finished with a brick veneer, exterior flange 20 would be formed into a brick molding.

Interior frame assembly 50 further comprises interior sill member 52, interior left jamb 54, interior right jamb 56, and interior header member 58, which are joined together to form interior frame 60. Interior flange 62 extends from an interior perimeter portion of interior frame 60 in a direction that is outward from the opening defined by interior frame 60. Interior flange 62 engages the exterior portion of the ICF to retain the concrete within the insulated form when the concrete is being poured. Interior flange 62 is also formed to properly mate with the material being used to finish the interior of the wall being formed.

Figure 2:
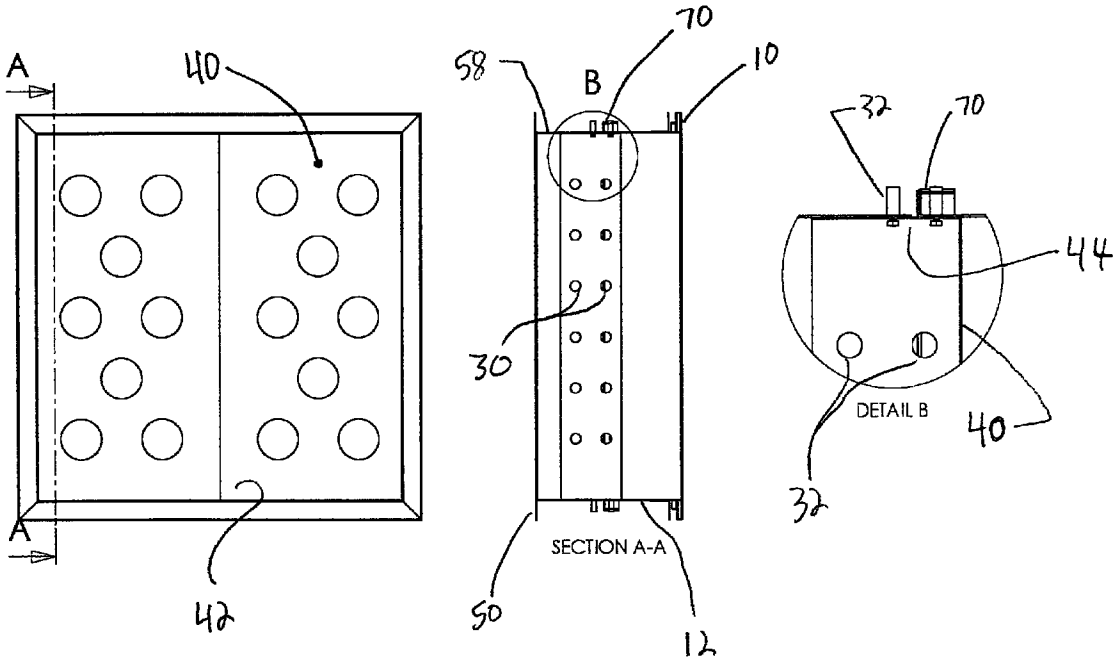
FIG. 2 includes plan, section, and detail views of the embodiment illustrated in FIG. 1.
Figure 7:
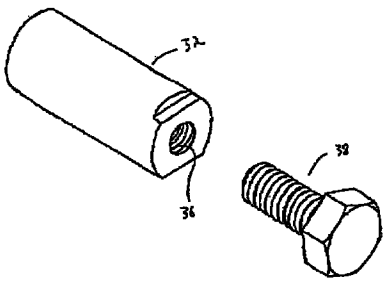
FIG. 7 is an illustration of an embodiment of the installation nut of the present invention.
Figure 6:
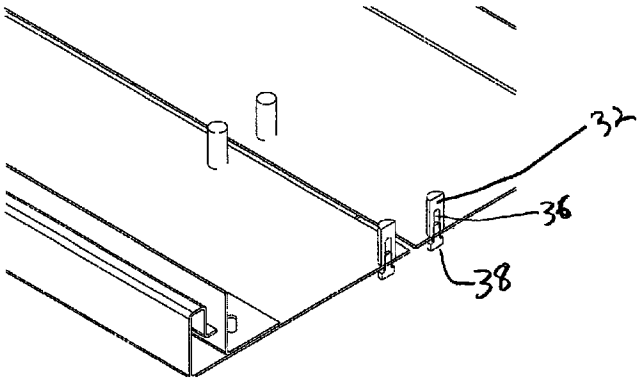
FIG. 6 is a detail view of the sectioned view of FIG. 5.

Exterior frame assembly 10 and interior frame assembly 50 each further comprise a plurality of installation openings 30 to which installation nuts 32 are connected. As illustrated in FIGS. 1 and 2, installation nuts 32 are metal studs that extend outward from exterior frame 20 and interior frame 60. In the illustrated embodiment, installation nuts 32 are adapted to be press fit and/or welded to exterior frame 20 and interior frame 60. Installation nuts 32 also define threaded blind openings 36 (best seen in FIG. 7) that allow installation bolts 38 to be threaded into installation nuts 32 through installation openings 30. At least some of installation openings 30 are located in exterior frame 20 or interior frame 60 to allow for the window being installed in the opening defined by frame assembly 1 to be easily attached using bolts sized to engage threaded blind opening 36. Alternatively, installation nuts 32 may have an exterior threaded portion 34 (not shown) adapted to be threaded into installation openings 30.

Figure 4:
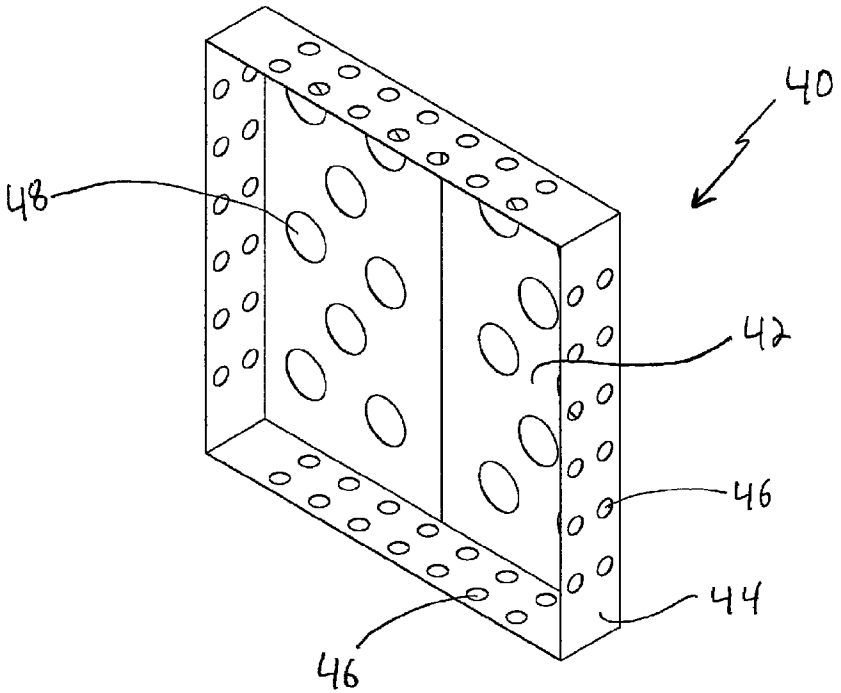
FIG. 4 is a perspective view of the installation support illustrated in the embodiment of FIG. 1.

Before frame assembly 1 is installed in the wall form, exterior frame assembly 10, thermal break 2, and interior frame assembly 50 are assembled together. In the embodiment illustrated in FIGS. 1 and 2, this is accomplished using installation support 40. Installation support 40, illustrated in a FIG. 4, comprises central section 42 having the same size as the opening defined by frame assembly 1. The perimeter portion of installation support 40 includes connection flange 44, which extends transversely from central section 42. Connection flange 44 includes connection apertures 46 that are arranged to coincide with installation openings 30 when installation support 40 is inserted into the opening defined by frame assembly 1. Installation bolts 38 are then introduced through connection apertures 46 and installation openings 30 and threaded into blind openings 36 in installation nuts 32. Installation support 40 can be formed of zinc-coated mild carbon steel, but any material that has sufficient corrosion resistance and strength to hold exterior frame assembly 10 and interior frame assembly 50 together and to prevent frame assembly 1 from deflecting when the concrete is introduced to the form may be used. In the illustrated embodiment, central section 42 of installation support 40 defines a plurality of openings 48. These openings have the benefit of reducing the weight of installation support 40 and facilitating communication between workers on opposite sides of the wall form.

Frame assembly 1 further comprises support beam 70. Support beam 70 is located around an external perimeter portion of frame assembly 1 between exterior flange 22 and interior flange 62, and it may be connected to either exterior frame assembly 10 or interior frame assembly 50 as necessitated by the particular application. If required, more than one support beam 70 may be used. (In FIGS. 1 and 2, the portion of support beam 70 that would be traversing the upper side of the frame assembly has been omitted to reveal other features of the frame assembly.)

Support beam 70 initially provides support and rigidity to frame assembly 1 before concrete is introduced into the wall form. Support beam 70 additionally serves to lock frame assembly 1 into place once the concrete has been introduced into the wall form. In the illustrated embodiment, support beam 70 has a Z-shaped cross-section and includes a plurality of locking apertures 72 in the upright portion of the Z shape and the upper portion of the Z shape. (For clarity, the upright portion of the Z shape refers to the portion of support beam 70 extending away from the opening defined by frame assembly 1 and the upper portion of the Z shape refers to the portion of support beam 70 farthest away from the opening defined by frame assembly 1 regardless of whether support beam 70 is on the top, bottom, or side of frame assembly 1.) Once the concrete cures in locking apertures 72, frame assembly 1 will be firmly locked into place on all axes. For increased strength and stability, a Z-shaped support beam 70 can be included on the exterior portion of both exterior frame assembly 10 and interior frame assembly 50.

Unlike known frames for use in ICF construction, the embodiment of frame assembly 1 shown in FIGS. 1 and 2, the ICF engages only with the inner wall surfaces 23 and 63 of exterior flange 22 and interior flange 62. In contrast, known frames include a pair of interior flanges and a pair of exterior flanges such that the interior wall of the ICF must be installed between the pair of interior flanges and the exterior wall of the ICF must be installed between the pair of exterior flanges. Thus, the instant invention has the added benefit of providing for easier installation since less exact alignment is required (i.e. the installer does not have to simultaneously align two walls of the ICF with two slots formed by the paired flanges in known frames). The instant invention also provides the added benefit that the concrete introduced into the ICF will cause the ICF to be compressed against exterior flange 22 and interior flange 62, serving to further lock frame assembly 1 into place. (In the known designs, the internal flange of each pair of flanges prevents the concrete from pushing against the portion of the ICF engaged with the external flange of each pair.)

Figure 3:
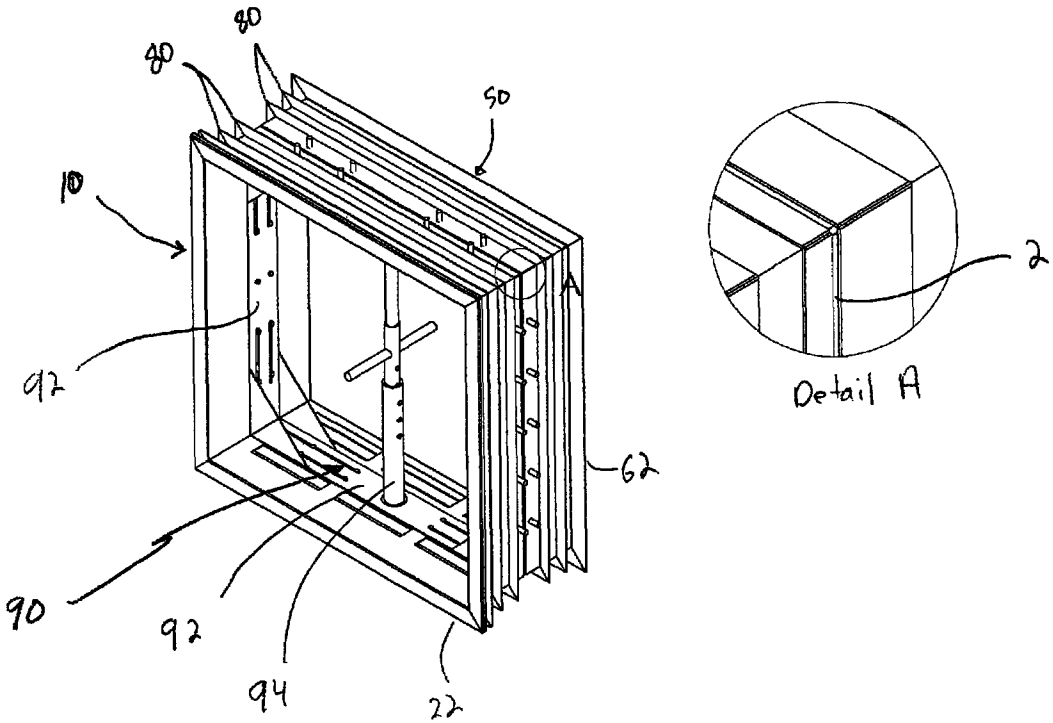
FIG. 3 is a perspective view of an alternate embodiment of the disclosed invention with a detail view showing the thermal break that is common to all embodiments of the disclosed invention.

FIG. 3 illustrates an alternative embodiment of the invention. In this embodiment, each of the exterior frame assembly 10 and the interior frame assembly 50 includes transversely projecting stiffening ribs 80 instead of one or more Z-shaped support beams. These ribs provide additional stiffness to the frame to improve its resistance to deflection when concrete is introduced into the wall form. The illustrated embodiment includes two ribs 80 on each of exterior frame assembly 10 and interior frame assembly 50, but more or less ribs could be used depending upon the particular application (for example, a particularly thick wall or large opening may require additional ribs). Rib 80 could also be provided with openings similar to those used in Z-shaped support beam to assist in locking frame assembly 1 into place. This configuration also provides the user with the ability, if desired, to locate the outermost rib 80 on each of exterior frame assembly 10 and interior frame assembly 50 apart from exterior flange 22 and interior flange 62 a sufficient distance to allow the ICF to fit tightly between the outermost rib 80 on each of exterior frame assembly 10 and interior frame assembly 50 and exterior flange 22 and interior flange 62.

Figure 5:
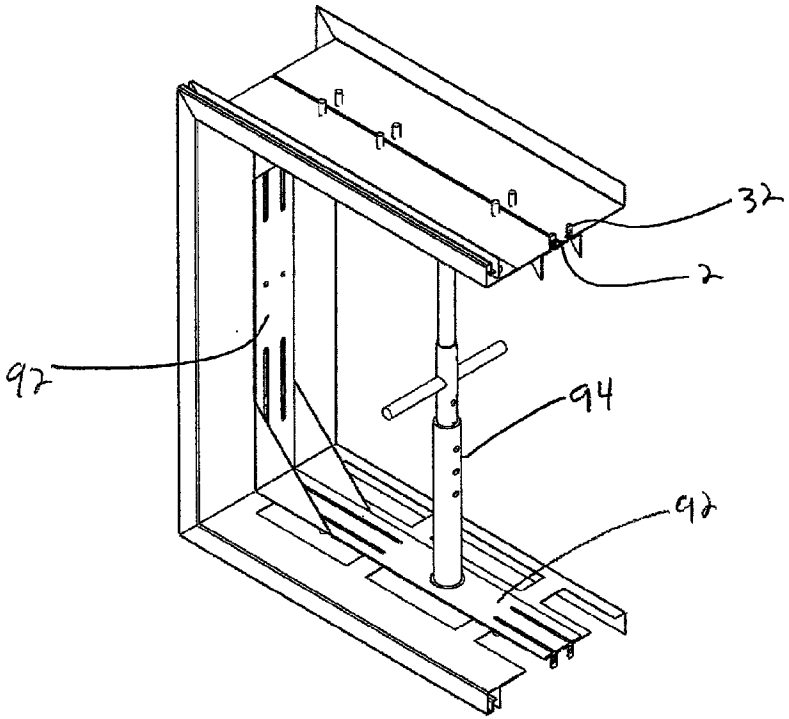
FIG. 5 is a sectioned perspective view of the embodiment of FIG. 3.
Figure 8:
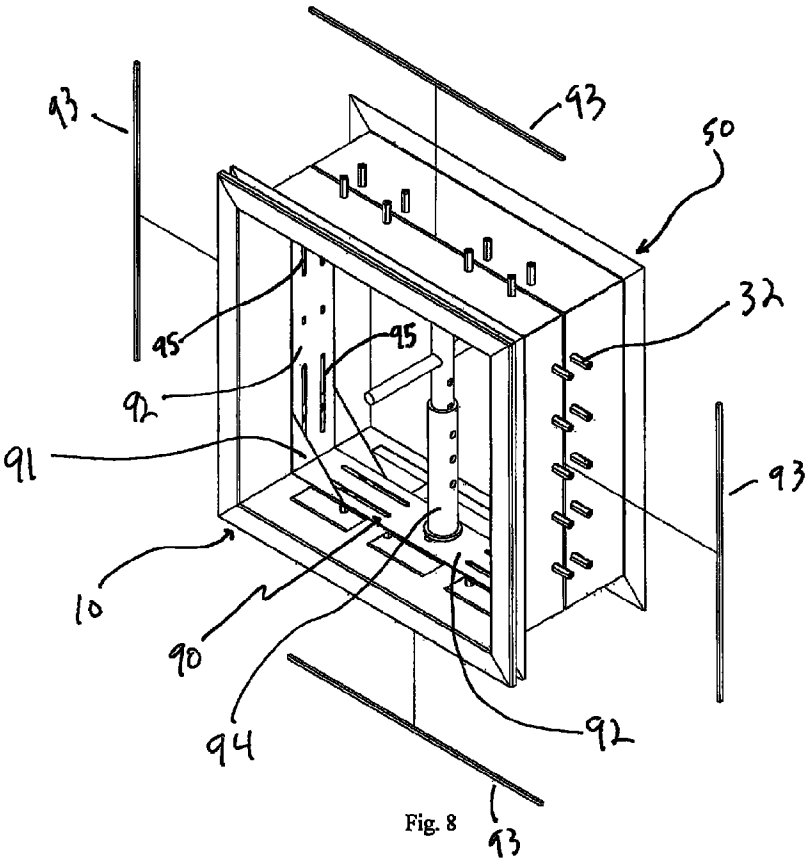
FIG. 8 is a perspective view of another embodiment of the disclosed invention.

Illustrated in FIGS. 3, 5, and 8 is installation support 90. This alternative installation support comprises a set of plates 92 that are attached to the interior perimeter of frame assembly 1 using installation bolts 38 threaded into installation nuts 32 through installation openings 30. Plates 92 preferably define slot-shaped connection apertures 95 and can be interconnected using plates 91. Screw mechanism 94 is then used to provide additional rigidity to withstand the weight of the concrete when it is introduced to the form and to facilitate the removal of installation support 90 once the concrete has cured. Installation support 90 could include a similar screw mechanism for additional horizontal support where needed, for example when frame assembly 1 is adapted for an opening to receive a tall window or a door. To improve the thermal performance of frame assembly 1, thermal break 2 can be comprised of gaskets 93 inserted between interior frame assembly 50 and exterior frame assembly 10. Gaskets 93 are preferably formed of a material with a lower thermal conductivity than concrete such as natural or synthetic rubber and may have one or more internal chambers to further decrease thermal conductivity. Gaskets 93 may also be removable once the concrete has cured; in this embodiment, thermal break 2 would comprise a dead air space between exterior frame assembly 10 and interior frame assembly 50. In an alternate embodiment, plates 92 could include ridge 96 (not shown) adapted to temporarily fill the gap between exterior frame assembly 10 and interior frame assembly 50 until the concrete is cured. Thus, when installation support 90 is removed, thermal break 2 would comprise a dead air space between exterior frame assembly 10 and interior frame assembly 50. Alternatively, once installation support 90 is removed, the gap could be filled with any suitable insulation material.

While the above describes the illustrated embodiment, those skilled in the art may appreciate that certain modifications may be made to the apparatus and methodology herein disclosed, without departing from the scope and spirit of the invention. For example, a frame for a door opening would be similar with the exception that the sill member would be replaced with a threshold and the jamb portions would be adapted to receive door. Thus, it should be understood that the invention may be adapted to numerous rearrangements, modifications, and alterations and that all such are intended to be within the scope of the appended claims.

We claim:

1. A frame assembly for use in a wall structure constructed using an insulated form into which concrete is poured comprising:

an exterior frame assembly, said exterior frame assembly having an exterior flange for locating said exterior frame assembly against an exterior portion of said insulated form, the exterior frame assembly further comprises an exterior frame formed by joining an exterior sill member, a left exterior jamb member, a right exterior jamb member, and an exterior header member, said exterior flange extending outward from said exterior frame parallel to the exterior portion of said insulated form;

an interior frame assembly, said interior frame assembly having an interior flange for locating said interior frame assembly against an interior portion of said insulated form; said exterior frame assembly and said interior frame assembly cooperating to define an opening in said wall structure, the interior frame assembly further comprises an interior frame formed by joining an interior sill member, a left interior jamb member, a right interior jamb member, and an interior header member, said interior flange extending outward from said interior frame parallel to the interior portion of said insulated form;

a series of corresponding mounting holes defined in the exterior frame and the interior frame;

a plurality of installation nuts connected to said exterior and interior frames in alignment with said mounting holes;

an installation support, said installation support including a plurality of connection apertures defined therein to align with said mounting holes defined in said exterior frame and said interior frame; wherein said installation support is removably affixed to the exterior frame and the interior frame using a plurality of installation bolts, said installation support further comprising a set of plates affixed to said exterior frame and said interior frame using the plurality of installation bolts and a screw mechanism extending between the plate affixed to the exterior sill member and the interior sill member and the plate affixed to the exterior header member and the interior header member; and a thermal break thermally separating said exterior frame assembly from said interior frame assembly.

* * * * *